United States Patent [19]

Fenelon

[11] 4,142,537

[45] Mar. 6, 1979

[54] ASH TRAY

[76] Inventor: John E. Fenelon, 1441 S. 61st Ave., Cicero, Ill. 60650

[21] Appl. No.: 837,582

[22] Filed: Sep. 28, 1977

[51] Int. Cl.[2] ..... A24F 19/00

[52] U.S. Cl. ..... 131/240 GG; 220/1 H; 220/8

[58] Field of Search ..... 131/231, 240 R, 240 GG, 131/241, 242; 220/8, 1 H

[56] References Cited

U.S. PATENT DOCUMENTS

| | | | |
|---|---|---|---|
| 21,955 | 11/1858 | Grosholz | 220/82 |
| 1,228,508 | 6/1917 | Wise, Jr. | 131/240 R |
| 3,791,548 | 2/1974 | Gili | 131/242 X |

FOREIGN PATENT DOCUMENTS

| | | | |
|---|---|---|---|
| 254466 | 7/1926 | United Kingdom | 131/240 GG |

*Primary Examiner*—Stephen C. Pellegrino

[57] ABSTRACT

An ash tray comprising a first portion having a bottom wall and a continuous wall upstanding therefrom, the continuous wall having a lip on its free end, and a second portion, the second portion having a plurality of concentric members telescopically connected, a first of the members having a free edge thereon shaped complementarily to the lip and engageable therewith to connect the first portion to the second portion, and a screen disposed in the second portion forming a barrier between the bottom wall and an opening defined by said second portion.

3 Claims, 2 Drawing Figures

ASH TRAY

BACKGROUND OF THE INVENTION

1. Field of the Invention

This invention relates to ash trays and is directed more particularly to an ash tray especially suitable for use in camping, boating, and the like.

2. Description of the Prior Art

Although a large number of ash tray designs have been developed and are readily available on the open market, there is a need for an ash tray particularly suitable for camping and boating environments, and the like. As such, the ash tray should be provided with means for insuring its compactness in travel, and its stability and safety in use.

SUMMARY OF THE INVENTION

An object of the present invention is therefore to provide an ash tray particularly adaptable to use in camping, boating, and other such endeavors.

A further object of the invention is to provide an ash tray which may be rendered extremely compact when not in use and which is exceptionally stable and safe while in use.

A still further object of the invention is to provide such an ash tray as is inexpensive to manufacture and simple and easy to operate.

With the above and other objects in view as will hereinafter appear, a feature of the present invention is the provision of an ash tray comprising a first portion having a bottom wall and a continuous wall upstanding therefrom, the continuous wall having a lip on its free end, and a second portion, the second portion having a plurality of concentric members telescopically connected, a first of the members having a free edge thereon shaped complementarily to the lip and engageable therewith to connect the first portion to the second portion, and a screen disposed in the second portion in a plane extending parallel to the bottom wall, the screen being about its entire periphery in engagement with interior portions of the second portion, the screen thereby forming a barrier between the bottom wall and an opening defined by the second portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
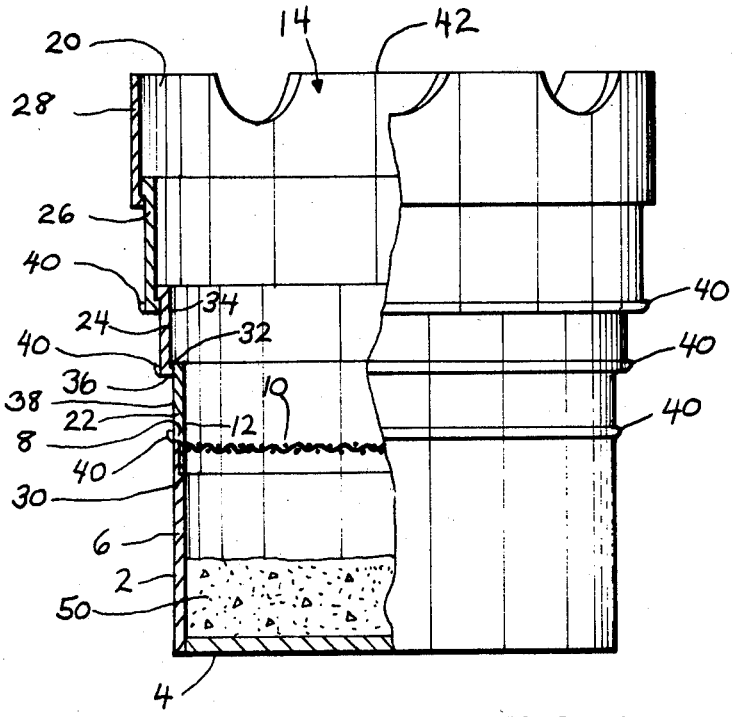
FIG. 1 is an elevational view, partly broken away, of one form of ash tray illustrative of an embodiment of the invention.
Figure 2:
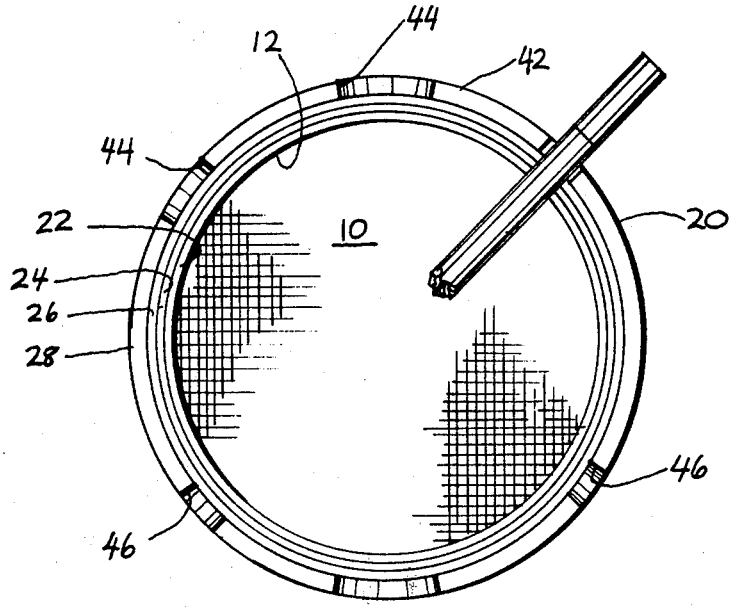
FIG. 2 is a plan view of the ash tray shown in FIG. 1.

Referring to the drawings, it will be seen that the illustrative device includes a first portion 2 having a bottom wall 4 and a continuous wall 6 upstanding therefrom. The wall 6 is provided with a lip 8 on its free end.

The device further includes a second portion 20, the second portion including a plurality of concentric members 22, 24, 26, 28 telescopically connected. A first of the members 22 is provided with a free edge 30 thereon shaped complementarily to the lip 8 and engageable with the lip 8 to connect the first portion 2 to the second portion 20.

A screen 10 is disposed in the second portion 29 in a plane extending parallel to the bottom wall 4 and is about its entire periphery in engagement with interior portions 12 of the second portion 20. The screen 10 thereby forms a barrier between the bottom wall 4 and an opening 14 defined by the second portion 20.

The first member 22 is provided at its end removed from the edge 30 with an outwardly extending flange 32 in engagement with an interior wall 34 of the second member 24. A first end of the second member 24 is provided with an inwardly extending flange 36 which is in engagement with an outside wall 38 of the first member 22. The outwardly extending flange 32 is slidable along the second member interior wall 34 and the inwardly extending flange 36 is slidable along the first member outside wall 38. Stop means 40 are provided for limiting the extent of the sliding movement between the various telescopic concentric members. Preferably, the stop means comprise projections, as shown in FIG. 1, extending outwardly from the outside walls of the various concentric members.

The illustrative embodiment includes four concentric members, of which the member 28 is furthest removed from the first portion 2 and is provided with a free edge 42 having a plurality of recesses 44, 46 therein. Preferably, the recesses 44, 46 are of different sizes to provide frictional holding means 40 different sizes of smoking instruments, such as cigarettes and cigars.

Preferably, the members 22, 24, 26, 28 and 2 are cylindrically shaped, but may alternatively be of any shape desired.

The first portion is provided with a weight means 50 which may be of permanent construction, such as metal, but is preferably of material readily added to and removed from the first portion 2. Materials suitable for such use include sand or water, either of which would normally be available in a camping or boating situation.

In use, the first and second portions may be carried separately if space is at a premium or may be carried connected together, but in either case with the second portion telescopically reduced in size. When ready for use, the first and second portions are joined together, if not already connected, and the concentric members are extended to the positions shown in FIG. 1. If a permanent weight is not included in the first portion, the user merely adds water or sand or earth to the bottom portion, before connecting the first member 22 to the first portion 2. The user then has readily available a weighted ash tray unlikely to tip over in the face of winds and readily telescoped to reduced size and readily emptied of weight material to reduce its carrying weight.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. An ash tray comprising a first portion having a bottom wall and a continuous wall upstanding therefrom, said continuous wall having a lip on its free end, and a second portion, said second portion having a plurality of concentric members telescopically connected, a first of said members having a free edge thereon shaped complementarily to said lip and engageable therewith to connect said first portion to said second portion, and a screen disposed in said second portion in a plane extending parallel to said bottom wall, said screen being about its entire periphery in engagement with interior portions of said second portion, said screen thereby forming a barrier between said bottom wall and an opening defined by said second portion.

2. The invention according to claim 1 in which said first member is provided at its end removed from said free edge with an outwardly extending flange in engagement with an interior wall of a second member and a first end of said second member is provided with an inwardly extending flange in engagement with an outside wall of said first member.

3. The invention according to claim 2 in which said outwardly extending flange is slidable along said second member interior wall and said inwardly extending flange is slidable along said first member outside wall.

* * * * *